US009279311B2

(12) United States Patent
Kellner et al.

(10) Patent No.: US 9,279,311 B2
(45) Date of Patent: Mar. 8, 2016

(54) SYSTEM, ASSEMBLY AND METHOD FOR PORT CONTROL

(75) Inventors: Justin Kellner, Pearland, TX (US); Matthew D. Solfronk, Katy, TX (US); John Travis Harris, Montgomery, TX (US); Paul Madero, Cypress, TX (US)

(73) Assignee: BAKER HUGHES INCORPORATION, Houston, TX (US)

( * ) Notice: Subject to any disclaimer, the term of this patent is extended or adjusted under 35 U.S.C. 154(b) by 230 days.

(21) Appl. No.: 12/729,894

(22) Filed: Mar. 23, 2010

(65) Prior Publication Data

US 2011/0232915 A1 Sep. 29, 2011

(51) Int. Cl.

| | |
|---|---|
| ***E21B 34/14*** | (2006.01) |
| ***E21B 21/10*** | (2006.01) |
| *E21B 34/00* | (2006.01) |

(52) U.S. Cl.

CPC ..... *E21B 34/14* (2013.01); *E21B 21/103* (2013.01); *E21B 2034/007* (2013.01)

(58) Field of Classification Search

CPC ..... E21B 34/14; E21B 2034/007
USPC ..... 166/318, 373, 386
See application file for complete search history.

(56) References Cited

U.S. PATENT DOCUMENTS

| | | | |
|---|---|---|---|
| 2,277,816 | A | 3/1942 | Brown |
| 2,376,594 | A | 5/1945 | Hite |
| 2,448,423 | A | 8/1948 | Dodge |
| 2,562,455 | A | 7/1951 | Gridley |
| 2,812,717 | A | 11/1957 | Brown |
| 3,117,797 | A | 1/1964 | Buck |
| 3,148,731 | A | 9/1964 | Holden |
| 3,263,752 | A | 8/1966 | Conrad |
| 3,358,771 | A | 12/1967 | Berryman |
| 3,517,939 | A | 6/1970 | Jaehn |
| 3,583,714 | A | 6/1971 | Weltzer et al. |
| 3,599,998 | A | 8/1971 | Kiwalle et al. |
| 3,669,462 | A | 6/1972 | Parsons |
| 3,703,104 | A | 11/1972 | Tamplen |
| 3,761,008 | A | 9/1973 | Goulder |

(Continued)

FOREIGN PATENT DOCUMENTS

| | | | |
|---|---|---|---|
| CA | 2760107 | A1 | 11/2010 |
| EP | 0427422 | A2 | 5/1991 |
| JP | 63174808 | A | 7/1988 |

OTHER PUBLICATIONS

International Search Report and Written Opinion of the International Searching Authority; PCT/US2010/044378; Mailed Mar. 17, 2011.

(Continued)

*Primary Examiner* — Brad Harcourt
(74) *Attorney, Agent, or Firm* — Cantor Colburn, LLP

(57) ABSTRACT

A port control system including a group of port control assemblies at least one of which delaying passage of a plug and at least one of which preventing passage of a plug, each assembly of the group configured to shift a sleeve to open one or more ports responsive to contact with a same sized plug upon fluid pressure differential across the plug; and at least one second group of port control assemblies at least one of which delaying passage of a plug and at least one of which preventing passage of a plug, each assembly of the group configured to shift a sleeve to open one or more ports responsive to contact with a same sized plug upon fluid pressure differential across the plug. A method is included.

15 Claims, 2 Drawing Sheets

(56) References Cited

U.S. PATENT DOCUMENTS

| | | | |
|---|---|---|---|
| 3,797,255 | A | 3/1974 | Kammerer, Jr. et al. |
| 3,954,138 | A | 5/1976 | Miffre |
| 3,997,003 | A | 12/1976 | Adkins |
| 4,067,358 | A | 1/1978 | Streich |
| 4,176,717 | A | 12/1979 | Hix |
| 4,190,239 | A | 2/1980 | Schwankhart |
| 4,246,968 | A | 1/1981 | Jessup et al. |
| 4,260,017 | A | 4/1981 | Nelson et al. |
| 4,292,988 | A | 10/1981 | Montgomery |
| 4,355,685 | A | 10/1982 | Beck |
| 4,423,777 | A | 1/1984 | Mullins et al. |
| 4,433,726 | A | 2/1984 | Preston, Jr. et al. |
| 4,438,811 | A | 3/1984 | Patel |
| 4,474,241 | A | 10/1984 | Freeman |
| 4,513,822 | A | 4/1985 | Gilbert |
| 4,554,981 | A | 11/1985 | Davies |
| 4,566,541 | A | 1/1986 | Moussy et al. |
| 4,655,290 | A | 4/1987 | Smith, Jr. |
| 4,657,078 | A | 4/1987 | Fraser, III et al. |
| 4,662,785 | A | 5/1987 | Gibb et al. |
| 4,714,116 | A | 12/1987 | Brunner |
| 4,715,445 | A | 12/1987 | Smith, Jr. |
| 4,726,425 | A | 2/1988 | Smith, Jr. |
| 4,729,432 | A | 3/1988 | Helms |
| 4,762,447 | A | 8/1988 | Marantette |
| 4,823,882 | A | 4/1989 | Stokley et al. |
| 1,856,591 | A | 8/1989 | Donovan et al. |
| 4,856,591 | A | 8/1989 | Donovan et al. |
| 4,893,678 | A | 1/1990 | Stokley et al. |
| 4,944,379 | A | 7/1990 | Haaser |
| 4,949,788 | A | 8/1990 | Szarka et al. |
| 4,979,561 | A | 12/1990 | Szarka |
| 4,991,653 | A | 2/1991 | Schwegman |
| 4,991,654 | A | 2/1991 | Brandell et al. |
| 5,020,946 | A | 6/1991 | Nann |
| 5,029,643 | A | 7/1991 | Winslow et al. |
| 5,029,644 | A | 7/1991 | Szarka et al. |
| 5,117,913 | A | 6/1992 | Themig |
| 5,207,274 | A | 5/1993 | Streich et al. |
| 5,230,390 | A | 7/1993 | Zastresek et al. |
| 5,305,837 | A | 4/1994 | Johns et al. |
| 5,325,917 | A | 7/1994 | Szarka |
| 5,335,727 | A | 8/1994 | Cornette et al. |
| 5,343,946 | A | 9/1994 | Morrill |
| 5,343,954 | A | 9/1994 | Bohlen et al. |
| 5,381,862 | A | 1/1995 | Szarka et al. |
| 5,394,941 | A | 3/1995 | Venditto et al. |
| 5,398,947 | A | 3/1995 | Cook |
| 5,425,424 | A | 6/1995 | Reinhardt et al. |
| 5,551,512 | A | 9/1996 | Smith |
| 5,567,093 | A | 10/1996 | Richmond |
| 5,609,178 | A | 3/1997 | Hennig et al. |
| 5,620,050 | A | 4/1997 | Barbee |
| 5,695,009 | A | 12/1997 | Hipp |
| 5,775,421 | A | 7/1998 | Duhon et al. |
| 5,775,428 | A | 7/1998 | Davis et al. |
| 5,890,540 | A | 4/1999 | Pia et al. |
| 6,053,250 | A | 4/2000 | Echols |
| 6,056,053 | A | 5/2000 | Giroux et al. |
| 6,102,060 | A | 8/2000 | Howlett et al. |
| 6,173,795 | B1 | 1/2001 | McGarian et al. |
| 6,220,350 | B1 | 4/2001 | Brothers et al. |
| 6,227,298 | B1 | 5/2001 | Patel |
| 6,253,861 | B1 | 7/2001 | Carmichael et al. |
| 6,378,609 | B1 | 4/2002 | ONeal et al. |
| 6,474,412 | B2 | 11/2002 | Hamilton et al. |
| 6,571,880 | B1 | 6/2003 | Butterfield, Jr. et al. |
| 6,626,244 | B2 | 9/2003 | Powers |
| 6,644,412 | B2 | 11/2003 | Bode et al. |
| 6,681,860 | B1 | 1/2004 | Yokley et al. |
| 6,712,145 | B2 | 3/2004 | Allamon |
| 6,712,415 | B1 | 3/2004 | Darbishire et al. |
| 6,763,891 | B2 | 7/2004 | Humphrey et al. |
| 6,907,936 | B2 | 6/2005 | Fehr et al. |
| 6,983,795 | B2 | 1/2006 | Zuklic et al. |
| 7,150,326 | B2 | 12/2006 | Bishop et al. |
| 7,210,534 | B2 | 5/2007 | Hayter et |
| 7,322,408 | B2 | 1/2008 | Howlett |
| 7,322,417 | B2 | 1/2008 | Rytlewski et al. |
| 7,337,847 | B2 | 3/2008 | McGarian et al. |
| 7,350,578 | B2 | 4/2008 | Szarka et al. |
| 7,367,399 | B2 | 5/2008 | Steele et al. |
| 7,377,321 | B2 | 5/2008 | Rytlewski |
| 7,416,029 | B2 | 8/2008 | Telfer et al. |
| 7,467,664 | B2 | 12/2008 | Cochran et al. |
| 7,520,336 | B2 | 4/2009 | Mondelli et al. |
| 7,703,510 | B2 | 4/2010 | Xu |
| 7,730,953 | B2 | 6/2010 | Casciaro |
| 7,798,212 | B2 | 9/2010 | Bolze et al. |
| 7,832,472 | B2 * | 11/2010 | Themig ..... 166/191 |
| 7,909,120 | B2 | 3/2011 | Slack |
| 7,971,883 | B2 | 7/2011 | Soroka et al. |
| 8,061,429 | B2 | 11/2011 | Du et al. |
| 8,291,988 | B2 | 10/2012 | King |
| 8,393,389 | B2 | 3/2013 | Brisco et al. |
| 8,443,894 | B2 | 5/2013 | Coghill et al. |
| 8,479,822 | B2 | 7/2013 | Hofman et al. |
| 8,684,096 | B2 | 4/2014 | Harris et al. |
| 8,727,010 | B2 | 5/2014 | Turner et al. |
| 9,074,451 | B2 | 7/2015 | Themig et al. |
| 2001/0007284 | A1 | 7/2001 | French et al. |
| 2002/0170717 | A1 | 11/2002 | Venning et al. |
| 2004/0007365 | A1 | 1/2004 | Hill et al. |
| 2004/0221984 | A1 | 11/2004 | Cram |
| 2005/0072572 | A1 | 4/2005 | Churchill |
| 2006/0124310 | A1 * | 6/2006 | Lopez de Cardenas et al. ..... 166/313 |
| 2006/0169463 | A1 | 8/2006 | Howlett |
| 2007/0007007 | A1 | 1/2007 | Themig et al. |
| 2007/0012438 | A1 | 1/2007 | Hassel-Sorensen |
| 2007/0095538 | A1 | 5/2007 | Szarka et al. |
| 2007/0272413 | A1 | 11/2007 | Rytlewski et al. |
| 2007/0289749 | A1 | 12/2007 | Wood et al. |
| 2008/0000697 | A1 * | 1/2008 | Rytlewski ..... 175/317 |
| 2008/0093080 | A1 | 4/2008 | Palmer et al. |
| 2008/0190620 | A1 | 8/2008 | Posevina et al. |
| 2008/0308282 | A1 | 12/2008 | Standridge et al. |
| 2009/0032255 | A1 | 2/2009 | Surjaatmadja et al. |
| 2009/0044944 | A1 | 2/2009 | Murray et al. |
| 2009/0044948 | A1 | 2/2009 | Avant et al. |
| 2009/0056934 | A1 | 3/2009 | Xu |
| 2009/0056952 | A1 | 3/2009 | Churchill |
| 2009/0101330 | A1 | 4/2009 | Johnson |
| 2009/0107680 | A1 | 4/2009 | Surjaatmadja |
| 2009/0159289 | A1 | 6/2009 | Avant et al. |
| 2009/0308588 | A1 | 12/2009 | Howell et al. |
| 2010/0294514 | A1 | 11/2010 | Crow et al. |
| 2011/0048723 | A1 | 3/2011 | Edwards |
| 2011/0073330 | A1 | 3/2011 | Radford |
| 2011/0108284 | A1 | 5/2011 | Flores et al. |
| 2011/0174500 | A1 | 7/2011 | Davies et al. |
| 2011/0180274 | A1 * | 7/2011 | Wang et al. ..... 166/386 |

OTHER PUBLICATIONS

International Search Report; PCT/US2010/033737; Korean Intellectual Property Office; Mailed Jan. 24, 2011.

International Search Report; Date of Mailing Jan. 24, 2011; International Appln No. PCT/US2010/034736; 3 pages.

International Search Report; Date of Mailing Jan. 24, 2011; Internatiaonal Appln. No. PCT/US2010/034735; 3 pages.

Nternational Search Report and Written Opinion; Date of Mailing Feb. 11, 2011; International Appln No. PCT/US2010/041049; International Search Report 5 pages and Written Opinion 3 pages.

Hoch, Ottmar, Marty Stromquist et al., "Multiple Precision Hydraulic Fractures of Low Permeability Horizontal Openhole Sandstone Wells," SPE Annual Technical Conference and Exhibition, Oct. 5-8, 2003, Denver Colorado.

Notification of Transmittal of the International Search Report and the Written Opinion of the International Searching Authority; PCT/US2010/044856; Mailed Apr. 15, 2011.

Notification of Transmittal of the International Search Report and the Written Opinion of the International Searching Authority; PCT/US2010/044383; Mailed Apr. 15, 2011.

(56) References Cited

OTHER PUBLICATIONS

International Search Report; PCT/US2010/044399; International Searching Authority KIPO; Mailed Mar. 21, 2011.
Notification of Transmittal of the International Search Report and the Written Opinion of the International Searching Authority; PCT/US2010/054487; International Searching Authority; KIPO; Mailed Jun. 3, 2011.
Notification of Transmittal of the International Search Report and the Written Opinion of the International Searching Authority; PCT/US2010/049810; International Searching Authority KIPO; Mailed Apr. 25, 2011.
International Search Report with Written Opinion; International Applictaion No. PCT/US2011/029622; International Filing Date: Nov. 8, 2010; 9 pages.
International Search Report and Written Opinion; Date of Mailing Aug. 29, 2011; International Application No. PCT/US2011/022523; International Filing Date Jan. 26, 2011; Korean Intellectual Property Office; International Search Report 5 pages; Written Opinion 3 pages.
Notification of Transmittal of the International Search Report and the Written Opinion of the International Searching Authority; PCT/US2011/041663; Korean Intellectual Property Office; Mailed Dec. 14, 2011; 8 pages.
Canadian Office Action for CA Application No. 2,794,111, dated Jul. 24, 2014, pp. 1-3.
International Search Report and Written Opinion for PCT Application No. PCT/US2010/034752, dated Jan. 27, 2011, pp. 1-7.
Canadian Office Action for CA Application No. 2,794,111, dated Apr. 17, 2015, pp. 1-3.

* cited by examiner

SYSTEM, ASSEMBLY AND METHOD FOR PORT CONTROL

BACKGROUND

In the downhole drilling and completion industry control of the opening of ports in certain sequences or individually can be important to a particular operation. One such operation is fracturing. It is sometimes desirable to "frac" an earth formation for the purpose of increasing the availability of production fluids to the borehole or to increase access of fluids from the borehole to the formation.

Many systems exist for "fracing" most of which use pressure that is significantly higher than that of the downhole pressure where the fracing operation is to take place and direct that pressure through one or more ports. Unfortunately, the process is time consuming and requires a relatively large number of tools be used. Both of these conditions are undesirable because of direct cast and delays, which translate to cost via a lack of revenue. For these reasons, the art is always receptive alternatives that improve efficiency.

SUMMARY

A port control system including a group of port control assemblies at least one of which delaying passage of a plug and at least one of which preventing passage of a plug, each assembly of the group configured to shift a sleeve to open one or more ports responsive to contact with a same sized plug upon fluid pressure differential across the plug; and at least one second group of port control assemblies at least one of which delaying passage of a plug and at least one of which preventing passage of a plug, each assembly of the group configured to shift a sleeve to open one or more ports responsive to contact with a same sized plug upon fluid pressure differential across the plug.

A method for carrying out an operation in a downhole environment in deploying a first plug; seating the plug in a first port control assembly of a group of port control assemblies all being responsive to a plug of a single set of dimensions; pressuring against the plug to actuate a first assembly of the first group of port control assemblies to a port open position and passing the plug through the assembly; seating the plug at least one other port control assembly of the first group of port control assemblies and actuating that assembly to a port open position; deploying a second plug having a set of dimensions different than the first plug; seating the plug in a first port control assembly of a second group of port control assemblies all being responsive to a plug of a single set of dimensions; pressuring against the plug to actuate the first assembly of the second group of assemblies to a port open position and passing the plug through the assembly; and seating the plug at least one other port control assembly of the second group of port control assemblies and actuating that assembly to a port open position.

A port control system including a group of port control assemblies at least one of which delaying passage of a plug and at least one of which preventing passage of a plug, each assembly of the group configured to shift a sleeve to open one or more ports responsive to contact with a same sized plug upon fluid pressure differential across the plug.

BRIEF DESCRIPTION OF THE DRAWINGS

Referring now to the drawings wherein like elements are numbered alike in the several Figures.

DETAILED DESCRIPTION

A port control system is disclosed that uses groups of port control assemblies that each respond to a same sized plug within the group. Other groups respond to other same sized plugs. As a system, operability of a fracturing operation for example is improved in efficiency since multiple ports can be opened with one plug and fractured and then a next group can be fractured the same way using a different sized plug. The number of groups possible is limited only by the plug size differential practicality. Each assembly is described for an understanding of the system.

Figure 1:
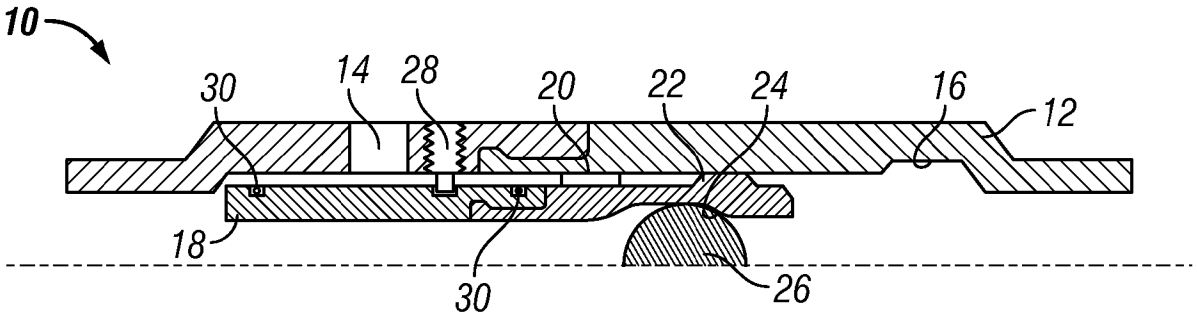
FIG. 1 is a schematic cross sectional view of a port control assembly as disclosed herein in a plug catching position.

Referring to FIG. 1, a port control assembly 10 is illustrated. The assembly includes a housing 12 having one or more ports 14 therein. The housing further includes a recess 16. A sleeve 18 is positioned radially of the housing 12 and longitudinally movably therein. The sleeve is restricted against rotational movement by a key 20 that extends from the housing to the sleeve 18. The key may be fixed to the sleeve, fixed to the housing, or slidable in both so long as rotational movement is not possible.

The sleeve 18 includes a load hold and release configuration 22 that in one embodiment is a collet (FIGS. 1 and 2) and may be one or more dogs (see FIG. 3), C-ring (see FIG. 4), etc. The hold and release configuration 22 includes a seat 24 that is configured to receive a plugging implement (hereinafter "plug") 26 such as a tripping ball, a dart, or other similar implement. As illustrated the leading portion of the plug 26 is shown in contact with the seat 24 in FIG. 1. The seat is to be sufficiently formed that the plug 26 will substantially or completely block fluid flow therepast such that pressure is buildable on an uphole side of the plug 26 (left in the drawing).

The sleeve 18 is initially maintained in place by a release member 28. The release member may be of any known kind and is illustrated broadly as a shear ring. Other members such as parting rings, detents, etc are known equivalents to one of ordinary skill in the art and do not require individual drawings.

Further the sleeve includes seals 30 that are positioned on the sleeve such that in a first position of the sleeve 18 relative to the housing 12, the seals 30 will be on either longitudinal end of the one or more ports 14. The one or more ports 14 are hence sealed by the sleeve 18 and the seals 30.

Figure 2:
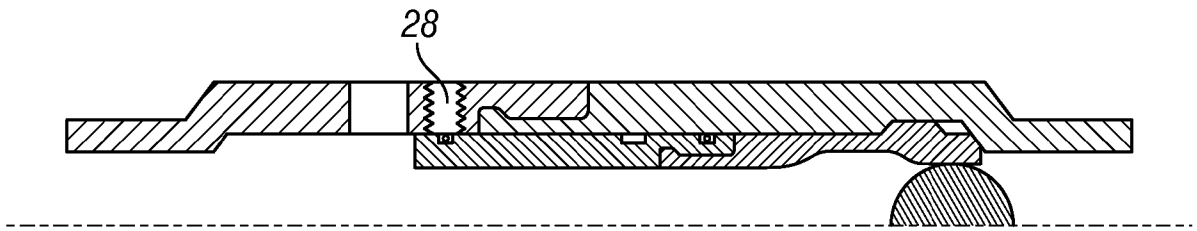
FIG. 2 is a schematic view of the port control assembly illustrated in FIG. 1 in a plug passing position.

In use, the port control assembly 10 is disposed in a borehole (open or cased). A plug 26 is dropped or pumped to the seat 24 and pressure is applied to fluid uphole of the plug 26. The pressure loads the release member 28 until it releases. It is noted that it is not necessary for the release value to be particularly high so that the pressure differential need not be substantial in order to release the release member 28. Once the pressure differential achieves the design point for the release member 28, the release member will release the sleeve 18, thereby allowing the sleeve 18 to move downhole. Movement of the sleeve downhole will be seen through FIGS. 1 and 2 to uncover the one or more ports 14. This occurs first in a sequence for each port control assembly 10. The next occurrence is that the hold and release component is caused to release the plug 26. This is accomplished in the illustrated embodiment by aligning a portion of the hold and release component 22 with the recess 16 and allowing the hold and release component 22 to deflect into the recess thereby enlarging the seat 24 of the hold and release component to a diameter larger than that of the plug 26, whereby the plug is free to pass through the seat 24. This is illustrated in FIG. 2.

An important aspect of the port control assembly as described is that it is usable with a number of other such assemblies in a system that is capable of opening a number of port areas (each area being a part of one assembly of the group of assemblies and having one or more ports) with a single plug 26. More specifically, because a plug 26 will land in a seat 24, open the sleeve 18 and pass through the seat 24 it can do precisely the same job on the next assembly 10 that is configured with the same size seat 24. It is an aspect of the invention to build such a system that includes one or more of the assemblies 10 as described and a similar assembly at a downhole extent of a particular group of assemblies of the system that does not include recess 16 or that the seat created in the last assembly in the group of assemblies is a nonexpandable seat. Without recess 16, the plug 26 will not pass the seat 24 and hence will hold pressure without release. It is this assembly of each group of assemblies that allows for fracturing pressure to be imposed on the open ports of a group of assemblies. It should be clear to the reader that not only can there be a number of assemblies 10 that use the same size plug 26 in a system but that the system may also be expanded to include more than one group of assemblies. More specifically, a full system may include for example, four assemblies 10 that use the same size plug at a downhole end of the full system and the downhole most of those assemblies being a nonpassing assembly; four more assemblies that use a different size plug than the first four assemblies do (larger), with the most downhole of those being a nonpassing assembly; four more assemblies uphole of the last group of four that each use the same size plug 26 but a larger one than the next downhole group of four (this group also having a nonpassing assembly at the downhole most position of the group); and so on. It is to be understood that the numeral four used in explanation is in no way intended to limit the number of assemblies used nor to convey that an equal number of assemblies must be in each groups. It is expressly noted that any number of assemblies desired may be designed into any groups of assemblies. Each of the assemblies in a group of assemblies uses the same size plug and each subsequently uphole group of assemblies uses a next larger plug size. One of ordinary skill in the art recognizes that the larger plugs are used more uphole since they do not physically fit into the more downhole components.

It should now be appreciated that a full system of the assemblies as described allows for an operator to actuate one or more assemblies with a single size plug 26 giving access to a selected number of ports associated with the groups of assemblies. In one embodiment there will be several assemblies used in each group. The collectively opened ports 14 provide a fracture access point for frac pressure while speeding the operation due to an increase in the length of the formation exposed at any given time.

While it is noted that because each plug actuates an uphole most assembly into which it has dimensions sufficient to land and thereby leaves an open port 14 uphole of the next downhole assembly, pressure can still be raised sufficiently to actuate the next downhole assembly due to restricted flow paths in the annulus and because the load required to release the release member 28 is not significant. Pressure delivered to the annulus through one or more open ports is attenuated before getting to the bottom of the hole and back to the downhole side of the plug 26. Differential pressure is thus still experienced by the plug.

Figure 3:
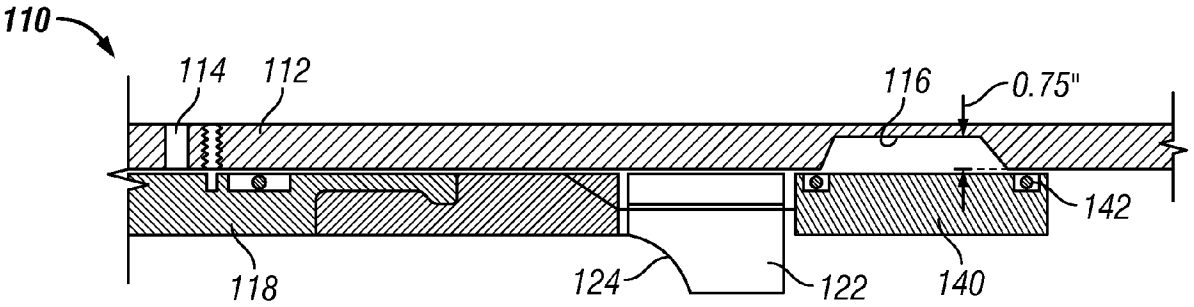
FIG. 3 is a schematic cross sectional view of an alternate embodiment of a port control assembly as disclosed herein.

In another embodiment of the assembly 10 of FIG. 1, reference is made to FIG. 3. In FIG. 3 is illustrated a port control assembly 110. The assembly includes a housing 112 having one or more ports 114 therein. The housing further includes a recess 116. A sleeve 118 is positioned radially of the housing 112 and longitudinally movably therein.

The sleeve 118 includes a load hold and release configuration 122 illustrated as one or more dogs. The hold and release configuration 122 includes a seat 124 that is configured to receive a plug 26 identical to the foregoing embodiment and not shown here. The seat 124 is to be sufficiently formed that a plug 26 will substantially or completely block fluid flow therepast such that pressure is buildable on an uphole side of such plug 26 just as in the embodiment of FIG. 1. In each respect, this embodiment is as it is in FIG. 1 except that the hold and release component 122 is one or more dogs and the dogs are slidable into the recess 116 to allow passage of a plug 26. This embodiment also includes an optional downhole shield 140 having seals 142 to prevent debris from entering the recess 116 prior to actuation of the assembly 110.

Figure 4:
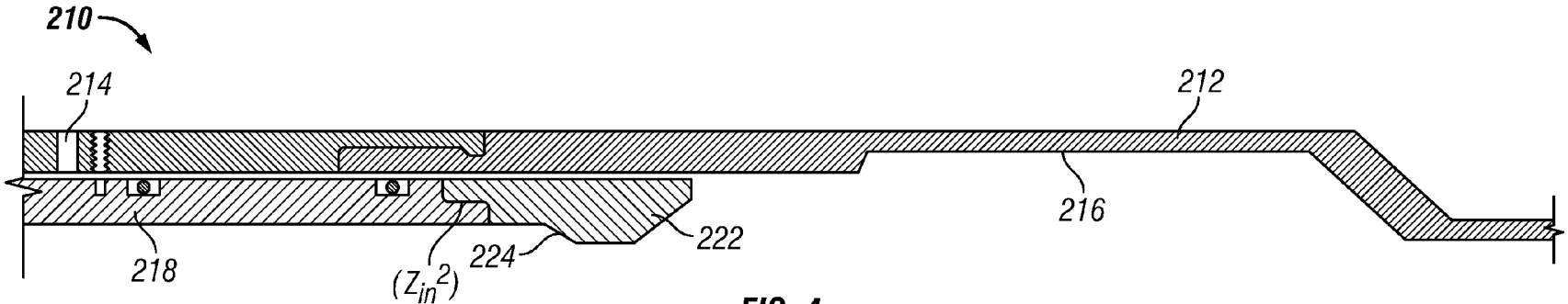
FIG. 4 is a schematic cross sectional view of another alternate embodiment of a port control assembly as disclosed herein.

In yet another embodiment of an assembly similar to that of FIG. 1, reference is made to FIG. 4. In FIG. 4 is illustrated a port control assembly 210. The assembly includes a housing 212 having one or more ports 214 therein. The housing further includes a recess 216. A sleeve 218 is positioned radially of the housing 212 and longitudinally movably therein.

The sleeve 218 includes a load hold and release configuration 222 illustrated as a C-ring. The hold and release configuration 222 includes a seat 224 that is configured to receive a plug 26 identical to the foregoing embodiment and not shown here. The seat 224 is to be sufficiently formed that a plug 26 will substantially or completely block fluid flow therepast such that pressure is buildable on an uphole side of such plug 26 just as in the embodiment of FIG. 1. In each respect, this embodiment is as it is in FIG. 1 except that the hold and release component 222 is a C-ring. The C-ring is expandable into the recess 216 to allow passage of a plug 26. C-rings are known to the art generally and one of ordinary skill in the art appreciates that C-rings are resilient structures. They can be configured to naturally hold a circular configuration where deflection is outwardly or a position that is open where deflection occurs toward the circular configuration. In the case of the embodiment of FIG. 4, the C-ring is configured to hold a circular geometry when at rest and under impetus, expand to increase an inside diametric dimension thereof. The purpose of this should be evident from the foregoing in that a configuration capable of expanding in its inside dimension is also capable of receiving a plug 26 that is selected to have a size to substantially seat thereagainst and then passing that plug 26 when translated to a position relative to housing 212 where the C-ring is aligned with the recess 216. The assembly 210 hence effectively works as do the other embodiments discussed herein.

Each of the foregoing embodiments of assemblies 10, 110, 210 is useable in a full system and can be mixed and matched if the particular application lends itself to such.

While one or more embodiments have been shown and described, modifications and substitutions may be made thereto without departing from the spirit and scope of the invention. Accordingly, it is to be understood that the present invention has been described by way of illustration and not limitation.

The invention claimed is:

1. A port control system comprising:

a group of port control assemblies at least one of which delaying passage of a first plug and at least one of which preventing passage of the first plug, each assembly of the group configured to shift a first sleeve from a first position to a second position to open one or more ports responsive to contact with the first plug upon fluid pressure differential across the first plug; the first sleeve shifting in a direction that is along a direction of movement of the first plug and expanding radially toward a housing of the port control system to reach the second position to open the one or more ports; and at least one second group of port control assemblies at least one of which delaying passage of a second plug and at least one of which preventing passage of the second plug, each assembly of the group configured to shift a second sleeve to open one or more ports responsive to contact with the second plug upon fluid pressure differential across the second plug.

2. A port control system as claimed in claim 1 wherein each assembly delaying passage of a plug comprises:

a housing having one or more ports and a recess;

a member disposed radially of the housing; and a hold and release component associated with the member and alignable with the recess upon differential pressure across a plug seated in the hold and release component during use.

3. A port control system as claimed in claim 2 wherein the assembly further includes a release member initially maintaining the member in a position associated with the one or more ports being closed.

4. A port control system as claimed in claim 3 wherein the release member is responsive to a load placed thereon and caused by a pressure differential across one of the plugs during use.

5. A port control system as claimed in claim 4 wherein the release member is one or more shear screws.

6. A port control system as claimed in claim 2 wherein the hold and release component is a collet.

7. A port control system as claimed in claim 2 wherein the hold and release component is one or more dogs.

8. A port control system as claimed in claim 2 wherein the hold and release component is a C-ring.

9. A port control system comprising:

a group of port control assemblies at least one of which delaying passage of a plug and at least one of which preventing passage of the plug, each assembly of the group configured to shift a member to open one or more ports responsive to contact with a same sized plug upon fluid pressure differential across the plug, shifting the sleeve to open the one or more ports including shifting the sleeve from a first position to a second position, shifting the sleeve in a direction that is along a direction of movement of the plug and expanding radially toward a housing of the group.

10. A port control system as claimed in claim 9 wherein each assembly delaying passage of a plug comprises:

a housing having one or more ports and a recess;

a member disposed radially of the housing; and a hold and release component associated with the member and alignable with the recess upon differential pressure across a plug seated in the hold and release component during use.

11. A port control system as claimed in claim 10 wherein the assembly further includes a release member initially maintaining the member in a position associated with the one or more ports being closed.

12. A port control system as claimed in claim 11 wherein the release member is responsive to a load placed thereon and caused by a pressure differential across a plug during use.

13. A port control system as claimed in claim 10 wherein the hold and release component is a collet.

14. A port control system as claimed in claim 10 wherein the hold and release component is one or more dogs.

15. A port control system as claimed in claim 10 wherein the hold and release component is a C-ring.

* * * * *